US006145439A

United States Patent [19]

Ziemba

[11] Patent Number: 6,145,439

[45] Date of Patent: Nov. 14, 2000

[54] RC TIME DELAY SELF-DESTRUCT FUZE

[75] Inventor: Richard T. Ziemba, Burlington, Vt.

[73] Assignee: General Dynamics Armament Systems, Inc., Falls Church, Va.

[21] Appl. No.: 09/097,381

[22] Filed: Jun. 16, 1998

Related U.S. Application Data

[60] Provisional application No. 60/071,502, Jan. 14, 1998, provisional application No. 60/071,503, Jan. 14, 1998, and provisional application No. 60/071,504, Jan. 14, 1998.

[51] Int. Cl.[7] ..... F42C 9/16; F42C 11/00

[52] U.S. Cl. ..... 102/266; 102/500; 102/206

[58] Field of Search ..... 102/499, 500, 102/237, 238, 231, 232, 257, 264, 266, 267, 265, 206

[56] References Cited

U.S. PATENT DOCUMENTS

| | | |
|---|---|---|
| 2,909,122 | 10/1959 | Shoemaker . |
| 2,926,610 | 3/1960 | Ruehlemann . |
| 3,353,486 | 11/1967 | Haiken . |
| 3,397,640 | 8/1968 | Ziemba et al. . |
| 3,595,169 | 7/1971 | Ziemba . |
| 3,610,153 | 10/1971 | Betts . |
| 3,670,652 | 6/1972 | Ziemba . |
| 3,714,898 | 2/1973 | Ziemba . |
| 3,844,217 | 10/1974 | Ziemba . |
| 4,026,215 | 5/1977 | Ziemba et al. . |
| 4,044,680 | 8/1977 | Ziemba . |
| 4,050,382 | 9/1977 | Power . |
| 4,242,963 | 1/1981 | Ziemba . |
| 4,494,459 | 1/1985 | Ziemba . |
| 5,243,912 | 9/1993 | Ziemba . |
| 5,343,795 | 9/1994 | Ziemba et al. . |

*Primary Examiner*—Jack W Lavinder
*Attorney, Agent, or Firm*—Finnegan, Henderson, Farabow, Garrett & Dunner

[57] ABSTRACT

Apparatus mountable in a projectile for utilization with a rotor-type safing and arming mechanism for post-launch self-neutralization of a projectile having a fused warhead and a stab detonator, including a launch-activated battery, an electric detonator positioned sufficiently close to the stab detonator to initiate the stab detonator upon initiation of the electric detonator, and a time delay switch circuit operatively interconnecting the battery and the electric detonator after a predetermined delay time for delivering power sufficient to initiate the electric detonator. The time delay switch circuit includes an R-C delay circuit having a delay capacitor, and an SCR connected in series between the electric power source and the electric detonator, with the SCR gate operatively connected to the delay capacitor. The apparatus also includes a pre-launch shorting circuit electrically connected in parallel with the electric detonator, and a current amplifier interconnected with the SCR and a storage capacitor.

21 Claims, 12 Drawing Sheets

RC TIME DELAY SELF-DESTRUCT FUZE

This application claims priority to Provisional Applications 60/071,503, 60/071,504 and 60/071,502 all filed Jan. 14, 1998, the disclosures of which are hereby incorporated by reference.

A related application of the same inventor, Ser. No. (not yet assigned), is being filed concurrently herewith and entitled "Spin Decay Self-Destruct Fuze".

BACKGROUND OF THE INVENTION

1. Field of the Invention

This invention relates to self-destruct and self-neutralization mechanisms for explosive ordnance and to improved safing devices for impact-initiated explosive ordnance to include self-destruct and self-neutralization mechanisms.

2. Prior Art

The U.S. Military is increasingly demanding that, where practical, all new explosive ordnance devices being developed incorporate a fuzing system for neutralizing or otherwise self-destroying such munitions once they have completed their intended mission, and that this self-neutralizing feature is to be implemented using components which are independent of the primary initiating mechanism within the fuze.

The primary safety device of conventional fuzes is an out-of-balance rotor assembly which contains a stab-sensitive detonator. The rotor is retained in its "safe" position (detonator out-of-line with a firing pin and explosive booster) by means of a setback and spin forces release the rotor thereby allowing it to rotate into its "armed" position and translate the detonator into alignment with the firing pin and booster. At target impact, the rotor (with its detonator) is thrust forward into a fixed position firing pin to cause the detonator to function and the warhead to explode.

One deficiency of this conventional fuze is that with a low velocity target impact against soft targets (snow bank for example) there may be insufficient impact energy for the fuze to function properly. In that case, the round may be left fully armed and possibly with the firing pin partially imbedded into the detonator. This is a potentially dangerous situation if someone disturbs the round under these conditions. Thus, a self neutralization feature incorporated into the fuze which would cause the round to detonate or otherwise be incapacitated after a finite time following gun launch if target impact forces were insufficient to cause normal function of the fuze would be highly desirable.

SUMMARY OF THE INVENTION

In accordance with the invention as embodied and broadly described herein, the apparatus for post-launch self-neutralization of a projectile having a fused warhead including a stab detonator comprises a launch-activated electric power source; an electric detonator positioned in close proximity to the stab detonator; and a time delay switch circuit operatively interconnecting the electric power source and the electric detonator. Each of the electric power source, the time delay switch circuit, and the electric detonator are configured for mounting in the projectile.

Preferably, the electric power source is a liquid reserve battery, and the time delay switch includes an R-C delay circuit having a delay capacitor, and an SCR connected in series between the electric power source and the electric detonator, the SCR having a gate operatively connected to the delay capacitor.

It is further preferred that the apparatus further include shorting circuits electrically connected in parallel with the electric detonator and the power source, the shorting circuits each being activatable from a conducting state for times prior to launch, to a non-conducting state for times following launch by launch-induced setback or spin forces.

It is still further preferred that where the projectile has a spin-activated safing and arming mechanism including a housing and an out-of-balance rotor assembly pivotally mounted therein with the stab detonator being mounted on the rotor element, each of the electric power source and the time delay switch circuit are configured for mounting on one of the rotor assembly and the housing.

And it is yet still further preferred that the time delay switch includes a current amplifier operatively connected to the SCR and an energy storage capacitor operatively connected to said current amplifier, for amplifying the current delivered to the electric detonator through the time delay switch circuit.

Further in accordance with the present invention, or embodied and broadly described herein, the method for post-launch self-neutralizing a projectile having a fused warhead including a stab detonator includes the steps of providing in the projectile an electric power source and an electric detonator, the providing step including the substep of locating the electric detonator sufficiently close to the stab detonator to initiate the stab detonator upon the initiation of the electric detonator; activating the electric power source upon launch; and applying power from the electric power source to the electric detonator after a predetermined delay time to initiate the electric detonator and the stab detonator.

Preferably, the power applying step is accomplished using a time delay switch circuit having an SCR with a gate operatively connected to the electric power source through an R-C delay circuit, the step further including the substep of selecting the components of the R-C delay circuit in accordance with the predetermined delay time.

BRIEF DESCRIPTION OF THE DRAWINGS

A better understanding of the present invention will be had upon reference to the detailed description when read in conjunction with the accompanying drawing in which.

Reference will now be made to the present preferred embodiments of the invention which are illustrated in the accompanying drawing.

DESCRIPTION OF THE PREFERRED EMBODIMENTS

Figure 1:
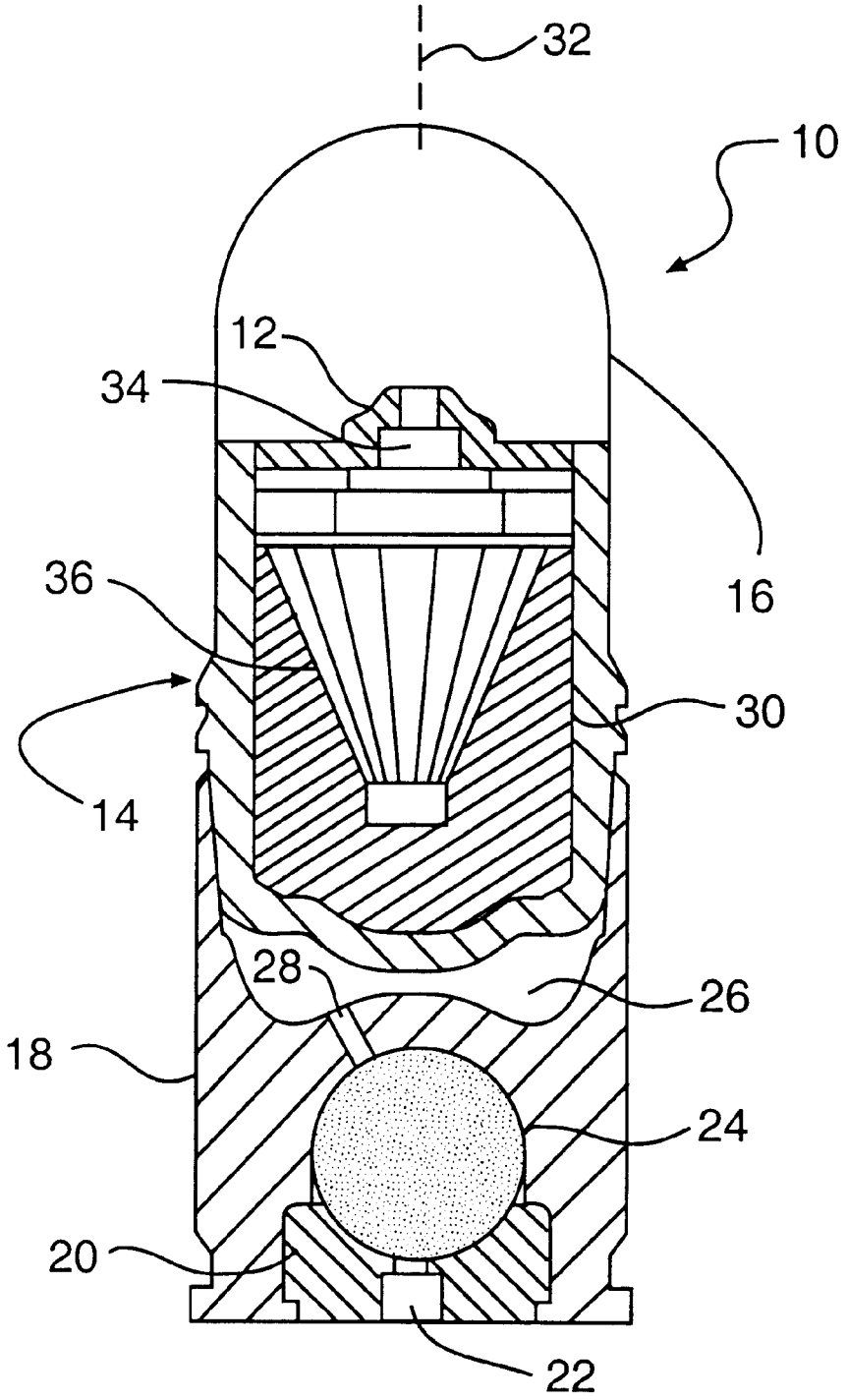
FIG. 1 PRIOR ART
FIG. 1 is a sectional schematic view of a conventional explosive, impact-initiated round.

FIG. 1 is a cross-sectional view of a gun-launched 40 mm projectile that can advantageously incorporate the present invention, as will be explained in detail hereinafter. Specifically, FIG. 1 shows an M430 grenade round 10 before any modifications are made to incorporate the present invention. Round 10 incorporates a point-initiating, base-detonating ("PIBD") fuze 12, a shaped charge warhead 14 and an anti-personnel fragmenting projectile body 16.

Round 10 also conventionally includes cartridge case 18 incorporating base plug 20 and percussion primer 22 designed to ignite propelling charge 24. Hot gases from ignited propelling charge 24 flow into low pressure chamber 26 via vent 28 to expel projectile body 16 from case 18. Round 10 also conventionally is used with a rifled gun barrel (not shown) and therefore incorporates one or more bands 30 to engage the barrel rifling to impart a spin to projectile body 16 about axis 32. Shaped charge 14 can be initiated by spit back charge 34, which is activated by PIBD fuze 12, and can have a copper liner 36 to increase explosive efficiency, as is well known.

The PIBD fuze 12, shown in more detail in FIG. 2, again in an unmodified state, contains a mechanical safing and arming ("S&A") device generally designated by the numeral 38 which controls the operation of an out-of-line explosive train by the action of projectile setback and spin forced.

More specifically, S&A device 38 includes stationary filing pin 40 mounted on housing cap 42 coincident with projectile axis 32. S&A device 38 further includes a rotor member 44 mounted for pivoting movement via pivot pin 46 extending between housing 48 and cap 42, about pivot axis 50. Pivot axis 50 is spaced from, but parallel to, projectile axis 32.

Figure 2:
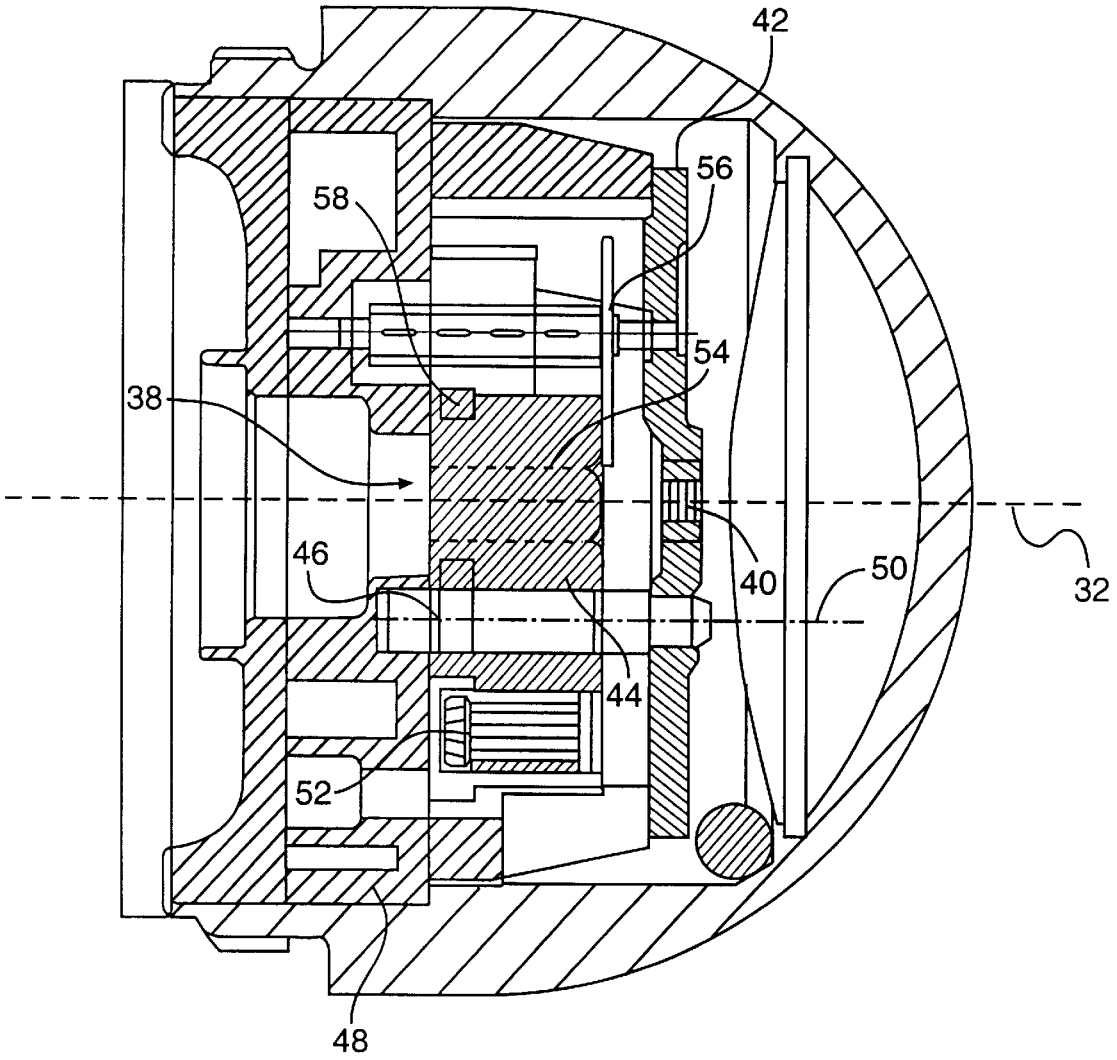
FIG. 2 PRIOR ART
FIG. 2 is a sectional schematic view of a detail from FIG. 1.

Stab detonator 52 is mounted in rotor element 44 spaced from pivot axis 50 an amount similar to the spacing between pivot axis 50 and projectile axis 32 such that upon pivoting movement of rotor element 44, stab detonator 52 moves from a position "out-of-line" with firing pin 40 (as shown in FIG. 2) to an "in-line" position shown dotted in FIG. 2 at 54. S&A device 38, an escapement device 56 extending between housing 48 and cap 42 which engages the teeth of sector gear 58 fixed to rotor element 44 to control the pivoting rate of rotor element 44 about pivot axis 50. When rotor element 44 is acted on by launch-induced spin forces. Typically, escapement device 56 limits the pivot rate such that stab detonator 52 does not reach the "in-line" position 54 at least until after the projectile has reached a safe distance from the gun. S&A device 38 also includes a safety setback pin and a spin-deactivated rotor lock, both known devices. These safety devices are overridden at launch by the launch-induced setback and spin forces allowing rotor element 44 to pivot under the control escapement device 56. Once fuze 12 is armed, target impact will cause firing pin 40 to initiate the explosive train and thereby set off warhead 14.

That is, after launch-induced forces have caused the setback safety pin to retract to a disengaged position and the rotor lock to disengage, allowing stab detonator 52 to pivot with rotor element 44 to the "in-line", armed position projectile impact normally will cause deformation of housing cap 42 and engagement of firing pin 40 with now in-line stab detonator 52. The initiation of stab detonator 52, in turn, activates spit back charge 34 (see FIG. 1) which initiates shaped charge 14.

Figure 3:
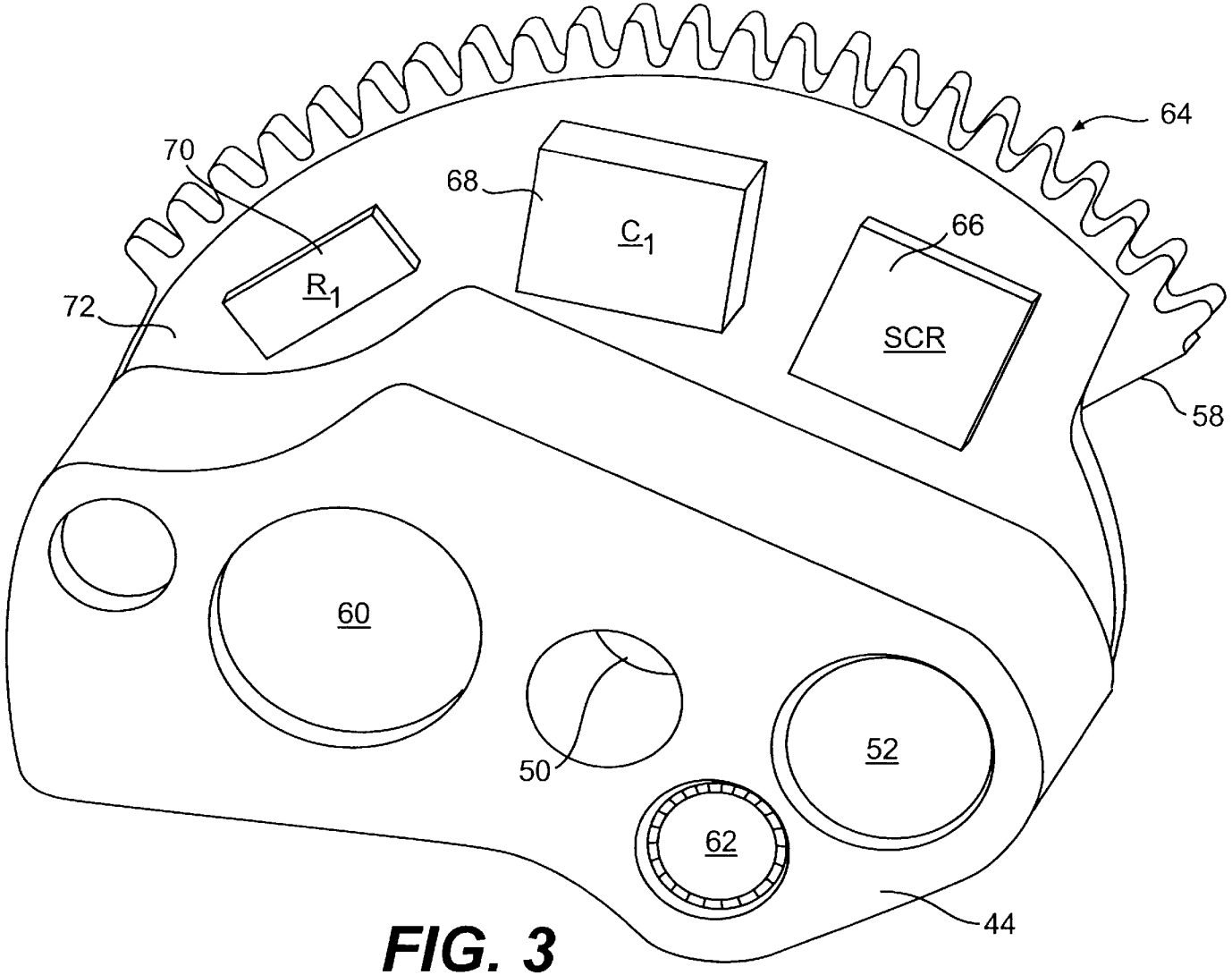
FIG. 3 is a perspective schematic view of a modification of the FIG. 1 round to incorporate a first embodiment of the present invention.

In accordance with the present invention, apparatus is included in the projectile for post-launch self-neutralization should the projectile not be fully armed or if impact does not initiate the fuze. Specifically, the apparatus includes an electric power source, an electric detonator, and a time delay switch interconnecting the power source and the electric detonator all configured for mounting within the projectile. As embodied herein and as best seen in FIG. 3, battery-type power source 60 and electric detonator 62 are mounted on rotor 44. Battery 60 is a liquid reserve battery such as a KDI/Alliant Techsystems part #23910009-01 providing 3.9 VDC and is a launch-activatable by means known to those skilled in the art. Electric detonator 62 is shown as an M100 such as manufactured by Martin Electronics, Inc., Perry, Fla., and is positioned sufficiently proximate stab detonator 52 to initiate detonator 52 upon initiation of electric detonator 62.

FIG. 3 further shows a time delay switch, generally 64, including SCR 66, capacitor 68, and resistor 70 mounted on printed circuit board 72. Circuit board 72, in turn, is bonded to sector gear 58 of rotor 44. Although not shown in detail in FIG. 3, circuit board 72 contains conductive leads or traces which interconnect battery 60 and electric detonator 62 through time delay switch 64 in a manner best seen in FIG. 4. Specifically, battery 60 is connected to the anode (emitter) of SCR 66 while the cathode (collector) of SCR 66 is connected to electric detonator 62. Battery 60 is also connected to capacitor 68 through resistor 70, and junction 72 of resistor 70 and capacitor 68 is connected to the gate of SCR 66.

In operation, when battery 60 is activated upon projectile launch capacitor 68 is charged through resistor 70. The values of these two components are chosen to develop 2.7 volts at junction 72 about 15–30 seconds after the 3.9 volt battery 60 is activated. Other delay times can, of course, be used. The 2.7 volt level, tied to the gate of the SCR 66, is sufficient to trigger SCR 66 into its conductive state, at which point, electric detonator 62 connected in series with SCR 66 and battery 60 is initiated.

Figure 4:
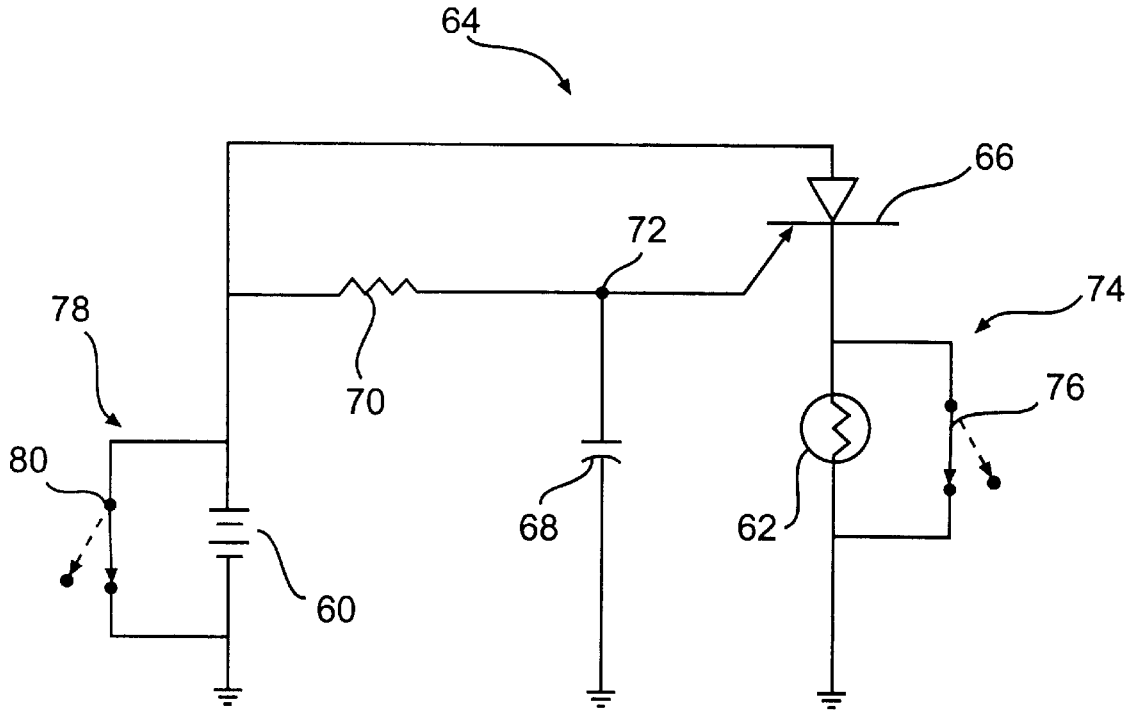
FIG. 4 is a detail of the time delay switch circuit component of FIG. 3 of the present invention.

As depicted schematically in FIG. 4, the projectile's self-neutralization apparatus also includes shorting circuits 74 and 78 that provide short circuiting respectively of electric detonator 62 and battery 60 for times prior to launch. Shorting circuits 74 and 78 include respective launch-induced force-activated switches 76 and 80. The switches 76, 80 open at gun firing removing the short circuit of the respective component. Although one or the other of shorting circuits 74 and 78 could be used alone, the redundancy provided by both circuits is preferred.

At projectile launch, rotor setback and spin safety devices release the rotor assembly allowing it to rotate to its armed position at a rate preset by the action of mechanically driven controlling escapement 56. Also at launch, reserve battery 60 is activated, powering the electronic time delay circuit switch which is pre-set to activate electric detonator 62 about 15–30 seconds after projectile launch. This period is somewhat in excess of the maximum time-of-flight of the round. Upon impacting a normal target, the fuze will function due to the action of stab detonator 52 against firing pin 40. If, on the other hand, the round impacts a soft target (e.g., a snow bank) with insufficient energy to initiate stab detonator 52, the aforementioned electronic self-neutralization apparatus will initiate the round after the 30 second period or at least initiate stab detonator 52 if it has not pivoted fully to the armed position. Under these conditions, no rounds are left in the field in a state where they could cause bodily harm to unsuspecting personnel.

FIGS. 5–8A show a second embodiment of the present invention. This embodiment also comprises a modification of the M549 PIBD fuze depicted in the first embodiment FIGS. 1–4, but configured to be used in a machine-gun launched grenade round. Components in the second embodiment with similar functions to those in the first embodiment use same reference numerals but with a 100 base (1 xx).

Figure 5:
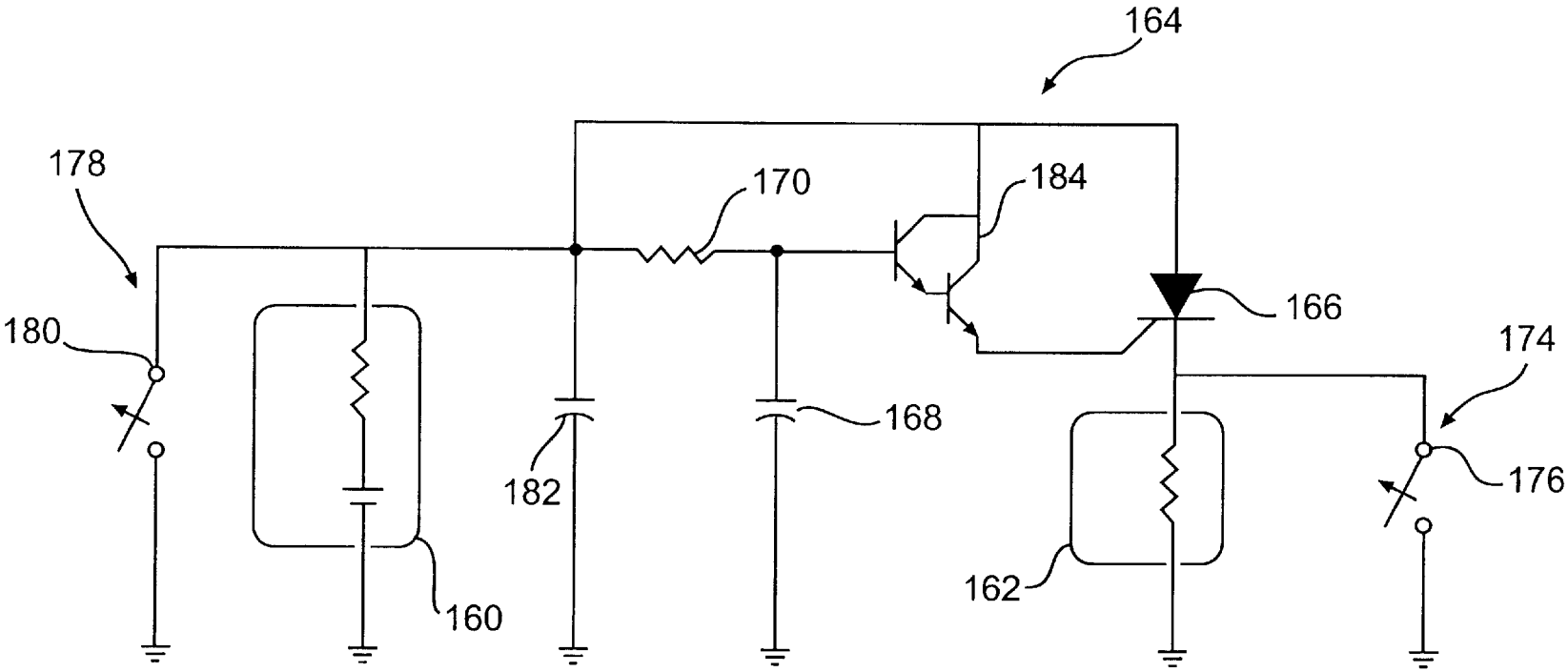
FIG. 5 is a detail of the time delay switch circuit component of a second embodiment of the present invention.

More specifically, FIG. 5 depicts an alternative time delay switch circuit 164. In comparison with switch circuit 64 shown in FIG. 4, the FIG. 5 circuit provides current amplification via capacitor 182 connected to the anode of SCR 166 in parallel with battery 160 and current amplifier 184. As in the previous embodiment, the time delay is provided by connecting the gate of SCR 166 to junction 172 of resistor 170 and capacitor 168 and resistor which is charged through resistor 170 by battery 160.

Once battery 160 is activated (about 200 milliseconds following projectile launch) energy storage capacitor 182 charges to the battery voltage (3.9 volts). This voltage is also applied to the emitter of the current amplifier 184 as well as to the anode of SCR 166 to power these devices. The charge on capacitor 182 is transferred to capacitor 168 through resistor 170 causing capacitor 168 to charge at a comparatively slower rate. The values of capacitor 168 and resistor 170 are selected so as to produce a firing level current at the gate of SCR 166 at about 15–30 seconds after battery 160 reaches its energized state. Current amplifier 184, in addition to providing current amplification to the gate of SCR 166, also prevents the SCR gate circuit from loading down the time delay circuit comprised of capacitor 168 and resistor 170.

When the gate current level of SCR 166 reaches a preset value, SCR 166 fires causing the energy stored on capacitor 182 to discharge through electric detonator 162 causing it to function.

Figure 6:
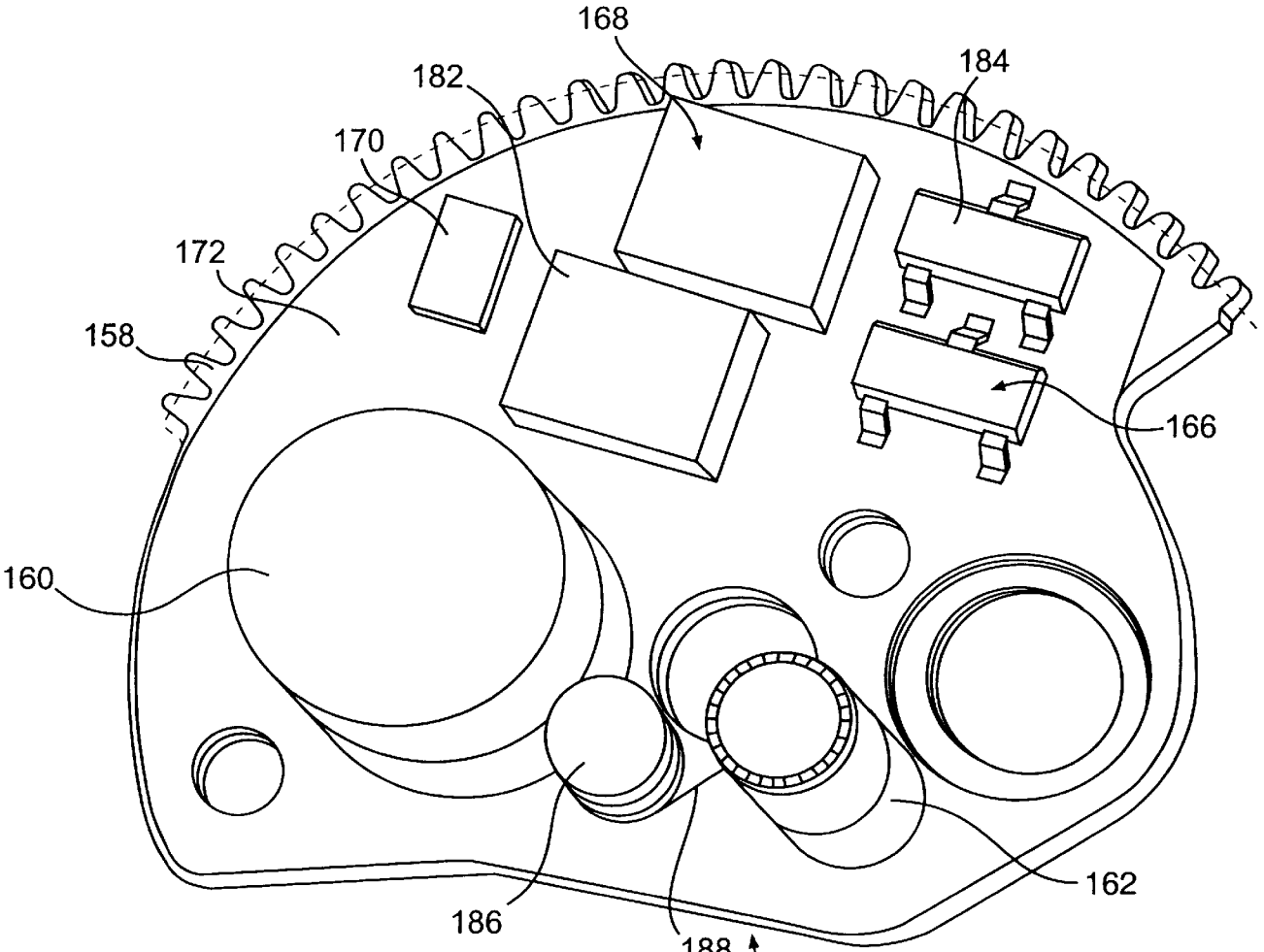
FIGS. 6 and 7 are perspective schematics of the embodiment of FIG. 5 integrated into components of a safing and arming mechanism.
Figure 7:
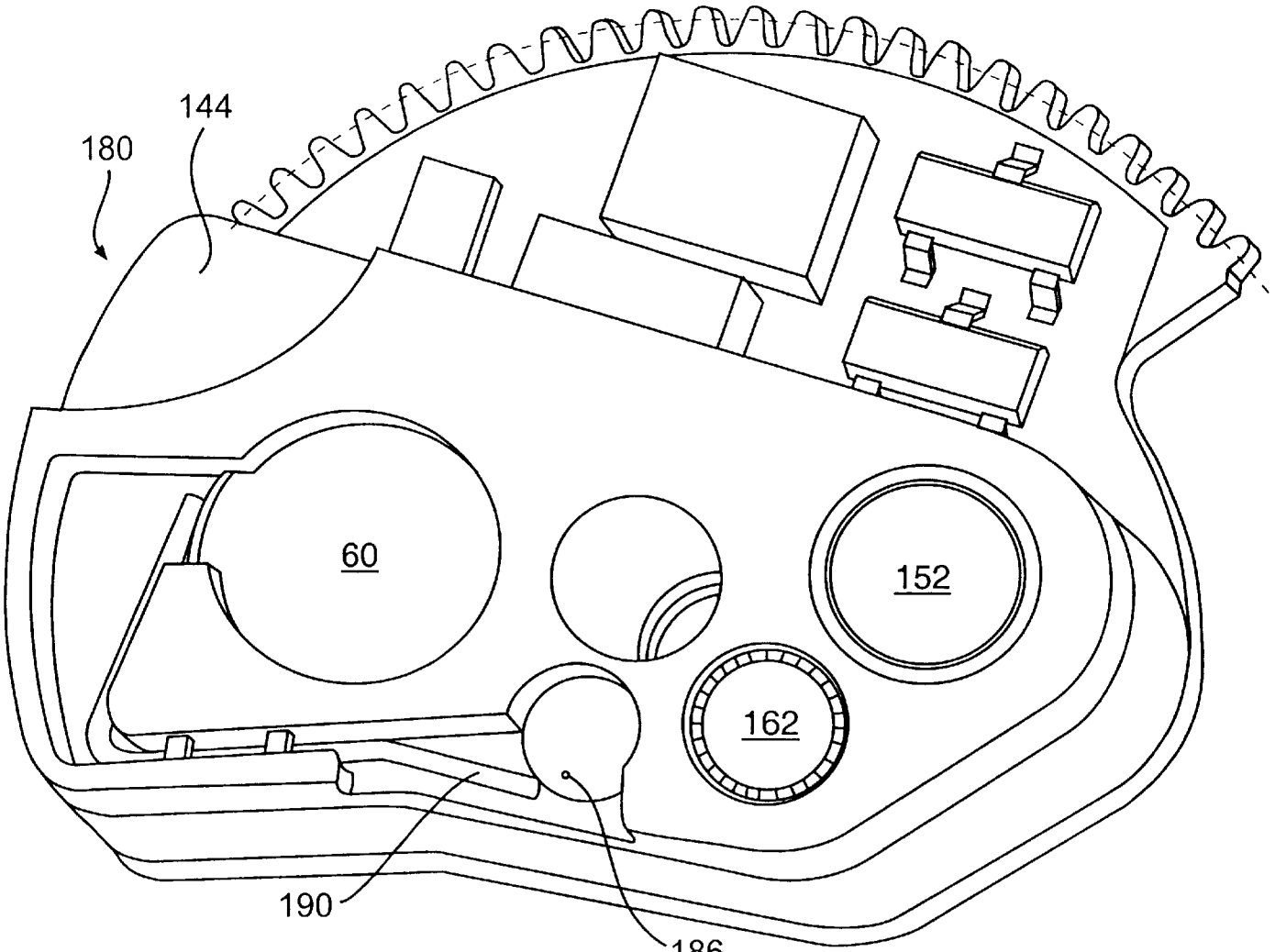
Figures 8, 8A:
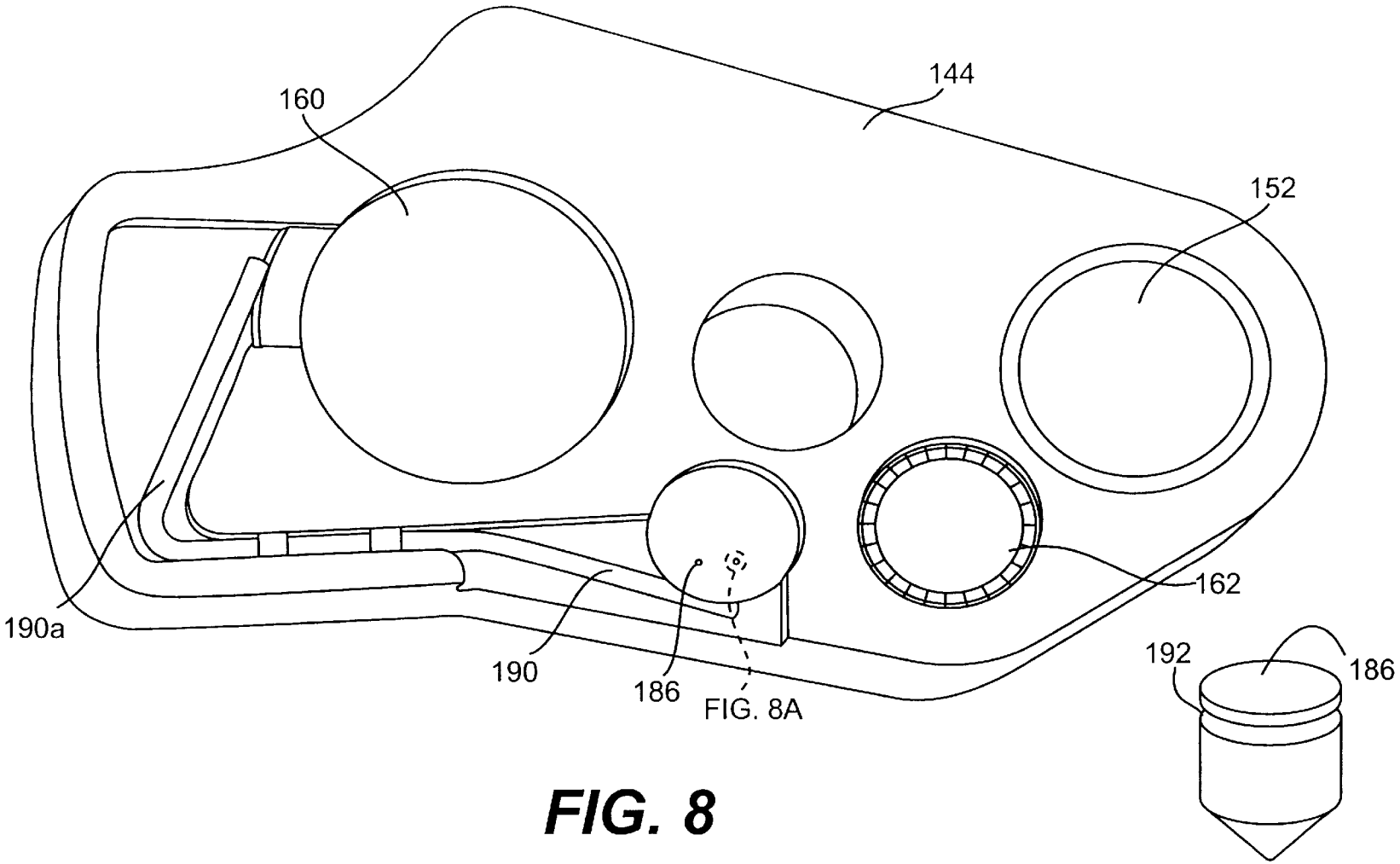
FIGS. 8 and 8A are further detail schematic views of the safing and arming mechanism of FIG. 7 and a part thereof, respectively.

FIG. 6 shows the components of the FIG. 5 time delay switch circuit mounted on sector gear 158 via printed circuit board 172, while FIG. 7 shows rotor 144 including sector gear 158. FIG. 6 also shows details of a preferred shorting circuit switch 176 used to deactivate shorting circuit 174 at launch, to enable electric detonator 162. As seen in FIGS. 6 and 8, setback weight 186 is pointed (see detail in FIG. 8A) and positioned to move axially to shear conductive lead 188 of circuit 174 on board 172 during launch, due to launch-induced setback forces (i.e., inertial forces directed in the axial direction). Weight 186 is held in place by spring detent 190 prior to launch and is insulated to prevent reestablishment of a conductive path.

FIGS. 7 and 8 shows details of preferred shorting circuit switch 180. In particular, free end 190*a* of detent spring 190 is configured as a cantilevered conductive contact for engaging the battery 160 to complete shorting circuit 180 prior to launch. Detent spring end 190*a* is configured to be permanently deformed in a direction away from battery 160 as a consequence of the launch-induced spin forces, thereby permanently deactivating battery shorting circuit 180 even during subsequent no-spin conditions.

FIGS. 9–12 depict yet a third preferred embodiment where some of the time delay switch circuit components are incorporated in the non-rotating housing of the S&A device rather than the rotor. Components similar to those in the FIG. 1–4 first embodiment are given the same numeral but with a 200 base (i.e., 2xx).

Figure 9:
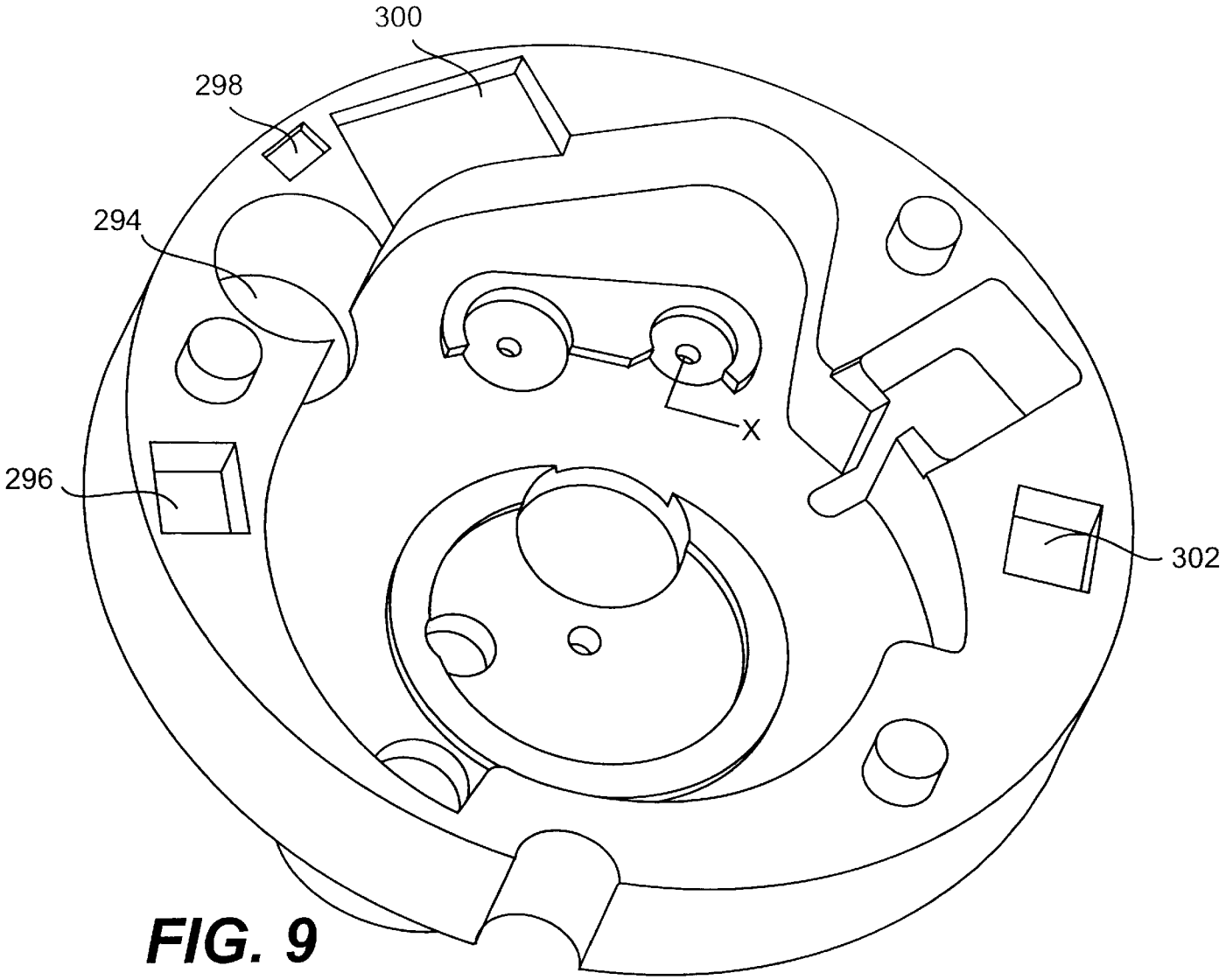
FIGS. 9–11 show a third embodiment of the present invention integrated with a safing and arming mechanism.
Figure 10:
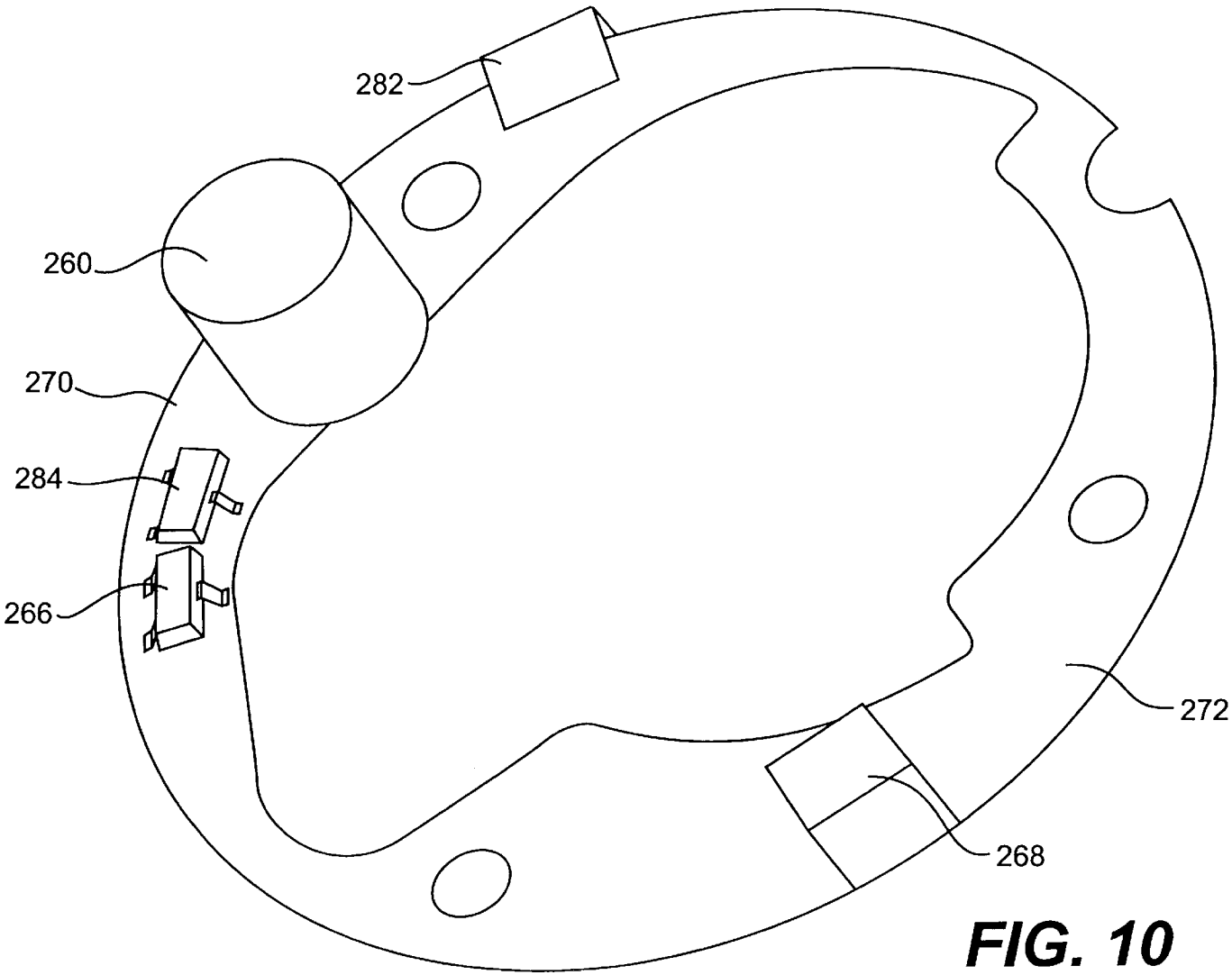
Figure 11:
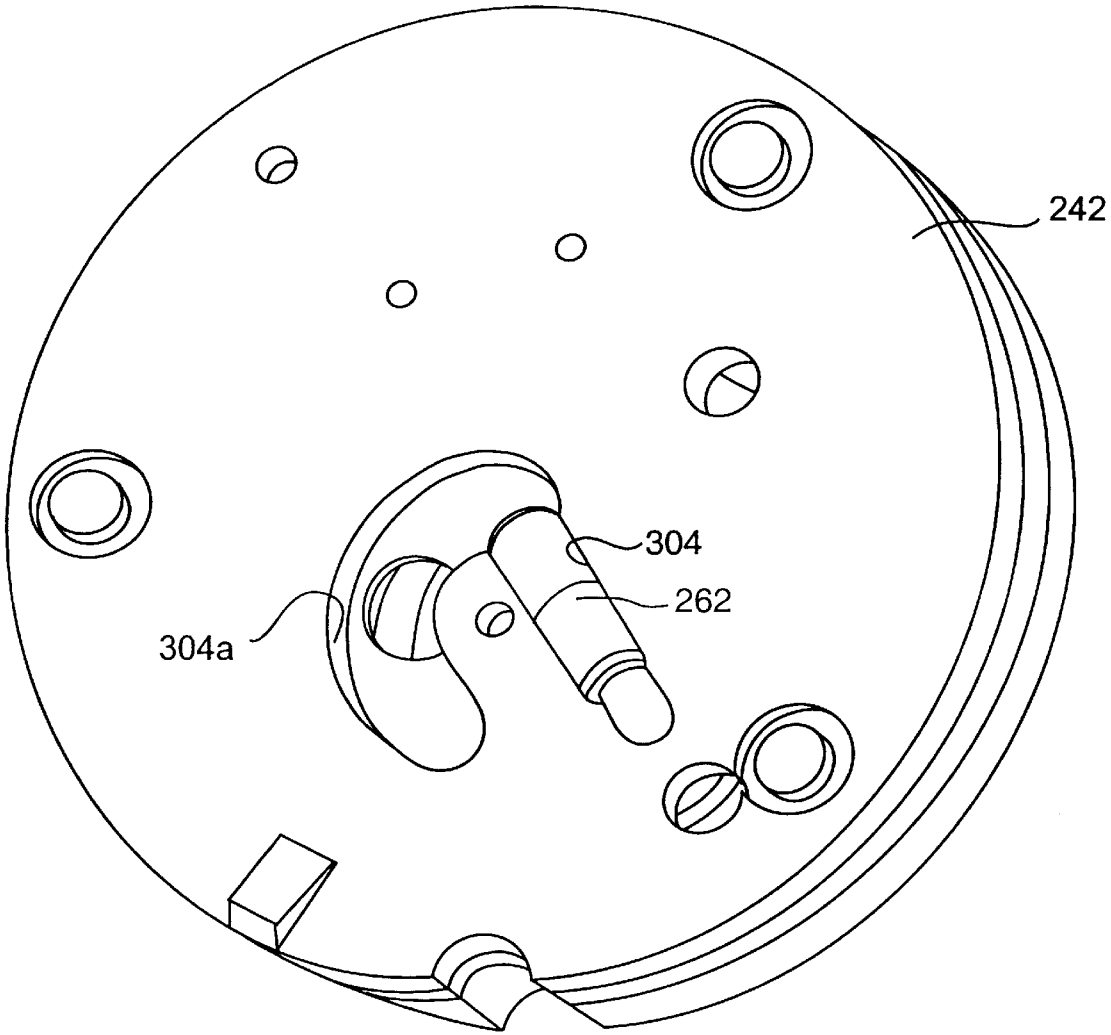

In particular, FIGS. 9 and 11 show molded plastic housing 248 and housing top cover plate 242, respectively, which encase the rotor assembly (not shown) of a M550 PIBD fuze used in rifle-launched grenades. Housing 248 shown in FIG. 9 has been configured to accept some components of the self-neutralization apparatus of the present invention which are mounted on printed circuit board 272 shown in FIG. 10. Circuit board 272 is captured between housing 248 and top cover plate 242 during assembly. Note the axial perspective view in FIG. 10 is opposite that in FIGS. 9 and 11. Specifically, housing 248 is modified to include cavity 294 to accept battery 260, cavity 296 to accept energy storage capacitor 282, cavity 268 to accept delay resistor 270, cavity 300 to accept current amplifier 284 and SCR 266, and cavity 302 to accept delay capacitor 268.

Figure 12:
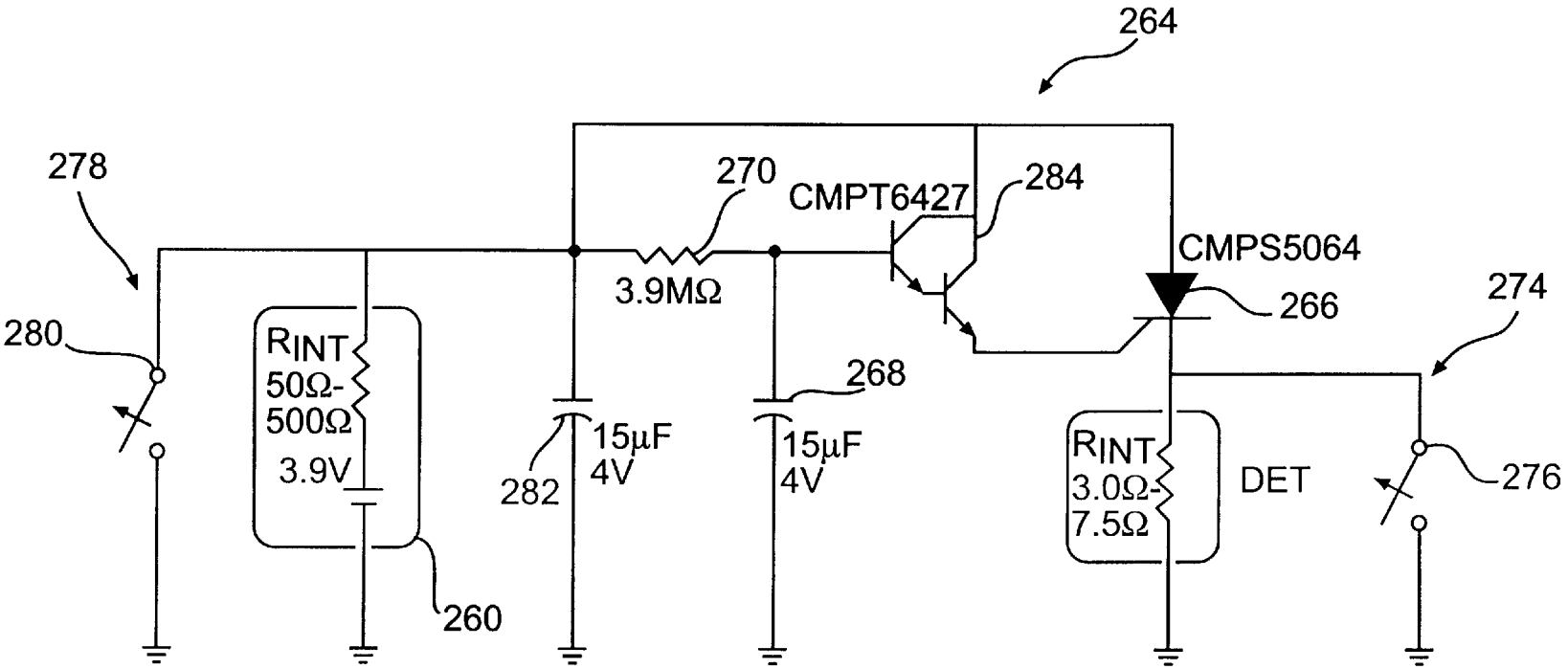
FIG. 12 is a detail of the time delay switch circuit of the embodiment of FIGS. 9–11.

The electrical configuration of time delay switch circuit 264 of the third embodiment as depicted in FIG. 12 with representative values and part numbers is essentially the same as depicted in FIG. 5. However, in the third embodiment both the battery shorting circuit 278 and the electric detonator shorting circuit 274 include respective switches deactivated by launch-induced setback forces. Also, electric detonator 262 is transversely mounted in cavity 304 of top cover plate 242, and cavity 304 is configured to have an arcuate extension 304*a* to provide a detonation path to the stab detonator (not shown) for rotor assembly positions in addition to the fully armed position.

It will be apparent to those skilled in the art that various modifications and variations can be made in the above-described embodiments of the present invention without departing from the scope or spirit of the invention. Thus, it is intended that the present invention cover such modifications and variations provided they come within the scope of the appended claims and their equivalents.

What is claimed:

1. Apparatus for post-launch self-neutralization of a projectile having a fused warhead including a stab detonator, the apparatus comprising:

an electric power source including a launch-activated battery operable to supply power upon launch of the projectile;

an electric detonator positioned sufficiently close to the stab detonator to initiate the stab detonator upon initiation of said electric detonator; and a time delay switch circuit operatively interconnecting said power source and said electric detonator after a predetermined delay time for delivering power sufficient to initiate said electric detonator, each of said power source, said time delay switch circuit, and said electric detonator being configured for mounting in the projectile.

2. The apparatus of claim 1 wherein the time delay switch circuit includes an R-C delay circuit having a delay capacitor, and an SCR connected in series between said electric power source and said electric detonator, said SCR having a gate operatively connected to said delay capacitor.

3. The apparatus as in claim 1 further including a shorting circuit electrically connected in parallel with said electric detonator, said electric detonator shorting circuit being activatable from a conducting state for times prior to launch, to a non-conducting state for times following launch.

4. The apparatus as in claim 3 wherein said electric detonator shorting circuit includes a launch-induced setback force-activated switch.

5. The apparatus of claim 1 wherein the projectile also has a spin-activated safing and arming mechanism including a housing and a rotor pivotally mounted therein, the stab detonator being mounted on the rotor, each of said electric power source and said time delay switch circuit being configured for mounting on one of the rotor and the housing.

6. A safing and arming mechanism having the apparatus of claim 5.

7. A projectile having the apparatus of claim 5.

8. A projectile having the apparatus of claim 1.

9. The apparatus as in claim 1 further including a shorting circuit electrically connected in parallel with said power source, said power source shorting circuit being activatable from a conducting state for times prior to launch to a non-conducting state for times following launch.

10. The apparatus as in claim 10 wherein the power source shorting circuit includes a launch-induced setback-force activated switch.

11. The apparatus as in claim 9 for projectiles having a launch-induced spin, wherein said power source shorting circuit includes a one-way spin switch.

12. An apparatus for post-launch self-neutralization of a projectile having a fused warhead including a stab detonator, the apparatus comprising:

an electric power source;

an electric detonator positioned sufficiently close to the stab detonator to initiate the stab detonator upon initiation of said electric detonator;

a time delay switch circuit operatively interconnecting said power source and said electric detonator after a predetermined delay time for delivering power sufficient to initiate said electric detonator, each of said power source, said time delay switch circuit, and said electric detonator being configured for mounting in the projectile; and a shorting circuit electrically connected in parallel with said power source, said power source shorting circuit being activatable from a conducting state for times prior to launch to a non-conducting state for times following launch, the shorting circuit including a launch-induced setback-force activated switch, wherein the setback-force activated switch includes a conducting element and a movable weight element disposed to shear said conducting element when acted upon by launch-induced setback forces.

13. An apparatus for post-launch self-neutralization of a projectile having a fused warhead including a stab detonator and a launch-induced spin, the apparatus comprising:

an electric power source;

an electric detonator positioned sufficiently close to the stab detonator to initiate the stab detonator upon initiation of said electric detonator;

a time delay switch circuit operatively interconnecting said sower source and said electric detonator after a predetermined delay time for delivering power sufficient to initiate said electric detonator, each of said power source, said time delay switch circuit, and said electric detonator being configured for mounting in the projectile; and a shorting circuit electrically connected in parallel with said power source and including a one-way spin switch, said power source shorting circuit being activatable from a conducting state for times prior to launch to a non-conducting state for times following launch, wherein said one-way spin switch includes a cantilevered contact element disposed in a position for conductively engaging said power source, said contact element configured to permanently deform into a conducting position when acted upon by launch-induced spin forces.

14. A method for post-launch self-neutralizing a projectile having a fused warhead including a stab detonator, the method including the steps of:

a. providing in the projectile an electric power source and an electric detonator, the providing step including the substep of locating the electric detonator sufficiently close to the stab detonator to initiate the stab detonator upon the initiation of the electric detonator;

b. activating the electric power source with launch-induced setback forces; and c. applying power from the electric power source to the electric detonator after a predetermined delay time to initiate the electric detonator.

15. The method as in claim 14 wherein the power applying step is accomplished using a time delay switch circuit having an SCR with a gate operatively connected to the electric power source through an R-C delay circuit, the step further including the substep of selecting the components of the R-C delay circuit in accordance with the predetermined delay time.

16. The method of claim 15 wherein the components are selected to provide a delay time of about 15–30 seconds.

17. The method of claim 14 further including the steps of providing a shorting circuit for the electric detonator for times prior to launch and deactivating the shorting circuit for times subsequent to launch.

18. The method of claim 17 wherein the step of deactivating the electric detonator shorting circuit is accomplished using launch-induced setback forces.

19. The method of claim 14 further including the steps of providing a shorting circuit for the power source for times prior to launch and deactivating the shorting circuit for times subsequent to launch.

20. The method of claim 19 wherein the step of deactivating the power source shorting circuit is accomplished using launch-induced setback forces.

21. The method of claim 19 for use in projectiles having a launch-induced spin, wherein the step of deactivating the power source shorting circuit is accomplished using launch-induced spin forces.

* * * * *

UNITED STATES PATENT AND TRADEMARK OFFICE

CERTIFICATE OF CORRECTION

PATENT NO.: 6,145,439

DATED: November 14, 2000

INVENTOR(S): Richard T. ZIEMBA

It is certified that an error appears in the above-identified patent and that said Letters Patent is hereby corrected as shown below:

Claim 13, col. 7, line 53, delete "sower" and insert therefor --power--.

Signed and Sealed this

First Day of May, 2001

*Attest:*

Nicholas P. Godici

NICHOLAS P. GODICI

*Attesting Officer*

*Acting Director of the United States Patent and Trademark Office*